United States Patent [19]

Itoh et al.

[11] Patent Number: 4,849,287

[45] Date of Patent: Jul. 18, 1989

[54] IMAGE TRANSFER MATERIAL FOR THERMAL RECORDING

[75] Inventors: Nobuaki Itoh; Hiroaki Kobayashi; Masanori Mizouchi, all of Otsu, Japan

[73] Assignee: Toray Industries, Tokyo, Japan

[21] Appl. No.: 184,487

[22] PCT Filed: Oct. 9, 1986

[86] PCT No.: PCT/JP86/00517

§ 371 Date: Mar. 21, 1988

§ 102(e) Date: Mar. 21, 1988

[87] PCT Pub. No.: WO88/00531

PCT Pub. Date: Jan. 28, 1988

[30] Foreign Application Priority Data

Jul. 22, 1986 [JP] Japan ..... 61-172632

[51] Int. Cl.[4] ..... B41M 5/26

[52] U.S. Cl. ..... 428/337; 428/323; 428/409; 428/474.4; 428/913; 428/914

[58] Field of Search ..... 428/195, 206, 207, 323, 428/336, 474.4, 477.7, 913, 914, 337, 409, 484

[56] References Cited

U.S. PATENT DOCUMENTS 4,103,066 7/1978 Brooks et al. ..... 428/484

4,269,892 5/1981 Shattuck et al. ..... 428/484

*Primary Examiner*—Ellis P. Robinson

*Assistant Examiner*—P. R. Schwartz

*Attorney, Agent, or Firm*—Austin R. Miller

[57] ABSTRACT

This invention relates to an image transfer material for thermal recording of the electric current-conducting type. Since the image transfer material of the present invention comprises an aromatic polyamide film with a thickness of 1–10 μm, which contains 10–40% by weight of carbon black, and has a tensile strength in at least one direction of not less than 8 kg/mm$^2$ and a dimensional change in at least one direction at 200° C. under a load of 1 kg/mm$^2$ of 5% or less, and an ink layer formed on the film the image transfer material of the present invention is a thin image transfer material which excells in heat resistance and anti-pinhole property, which makes it possible to conduct high speed printing and to promote the printing quality.

8 Claims, No Drawings

IMAGE TRANSFER MATERIAL FOR THERMAL RECORDING

TECHNICAL FIELD

This invention relates to an image transfer material (such as ink ribbon and ink sheet) for thermal recording of the electric current-conducting type.

BACKGROUND ART

Recently, the thermal image transfer recording system is used in addition to the electrophotographic, ink jet and electrostatic recording system. As one of the thermal image transfer recording systems, the electric current-conducting system has been proposed. In this system, instead of giving thermal energy to the ink layer with a thermal head, electric current is conducted through an electroconductive film having a certain electric resistance, and the ink layer is melted or sublimated by the generated Joule's heat. For example, U.S. Pat. No. 4,103,066 discloses the use of a polycarbonate film containing carbon black as a base film of the material. Also, U.S. Pat No. 4,269,892 discloses the use of a polyester resin containing carbon black as the base film of the material. However, since the above-mentioned resins have poor affinity (wettability and the like) for the carbon black, the obtained films have poor mechanical characteristics. For example, as stated in U.S. Pat. No. 4,269,892, polycarbonate has small tensile elongation and the polyester has a tensile strength of as low as 4 kg/mm$^2$. Further, if a large current is conducted for the purpose of high speed printing, since the heat resistance of the film is not sufficient, the film may be thermally deformed or pinholes may be formed in the film. Thus, it is difficult to conduct high speed printing which generates much heat. Further, to compensate for this disadvantage, the film should have a thickness as great as 15 μm or more.

DISCLOSURE OF THE INVENTION

The present invention solves the above-mentioned problems and provides an image transfer material for thermal recording, which has a small thickness, by which high speed printing can be conducted and good printing quality can be obtained, and which is free from film breakage, wrinkles and pinholes.

That is, the present invention provides an image transfer material for thermal recording comprising an aromatic polyamide film with a thickness t (μm) of 1–10 μm, which film contains 10–40% by weight of carbon black and has a tensile strength in at least one direction of not less than 8 kg/mm$^2$, the specific surface resistivity Rs (KΩ/□) of the film satisfying the relationship of $2 \leqq Rs \times t \leqq 100$, the dimensional change of the film in at least one direction at 200° C. under the load of 1 kg/mm$^2$ being not more than 5%; and an ink layer formed on the film.

Since an aromatic polyamide having a good affinity for the carbon black (wettability) is used as the polymer constituting the base film, adding a large amount of carbon black does not degrade the mechanical characteristics of the film and the small thickness of 1–10 μm of the film does not bring about wrinkles and film breakage during a run. Since the thinness of the film reduces the thermal diffusion, topical heating of the ink can be accomplished, so that the printing quality may greatly be improved. Further, since the heat capacity of the film, and in turn, the recording energy is reduced, the size of the power supply, cassette and the like may be reduced, so that the printer can be made compact.

On the other hand, in cases where high speed printing is desired, a large amount of energy can be given and the high speed printing can be accomplished without causing heat damage and pinholes. Although the reason why the pinholes are scarecely formed is not clear, it is assumed that since the base film is not deformed in printing due to high dimensional stability at high temperature, defects such as voids are unlikely to be formed; or even if the dimension is slightly changed, defects such as voids are unlikely to be formed because the affinity of the polymer for the carbon black is good. By employing a film having, in addition to the heat resistance, excellent affinity for carbon black, i.e., by employing a film having excellent mechanical characteristics, the present invention provides an image transfer material having very good anti-pinhole property. As mentioned above, the constitution of the present invention offers an excellent advantageous effects as an image transfer material of the electric current-conducting type.

BEST MODE FOR CARRYING OUT THE INVENTION

The aromatic polyamide used in the present invention is a polymer containing not less than 50 mol % of a basic recurring unit represented by the formula:

—HN-Ar$_1$-NHOC-Ar$_2$-CO— wherein Ar$_1$ and Ar$_2$ represent the following structures (1) and (2), respectively:

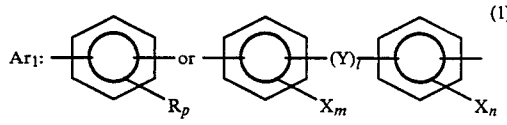

(1)

wherein R and X represent halogen, nitro group, C$_1$–C$_3$ alkyl group or C$_1$–C$_3$ alkoxyl group; Y represents $$-\underset{\underset{O}{\|}}{C}-,$$

—CH$_2$—, —O—, or —SO$_2$—; p, m and n represent 0–3, l represents 0 or 1.

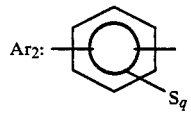

(2)

wherein S represents halogen, nitro group, C$_1$–C$_3$ alkyl group or C$_1$–C$_3$ alkoxyl group; q represents 0–4.

Among these, those polymers having substituents such as halogen (especially chlorine) and alkyl group (especially methyl group) as the R or S, and those polymers having alkyl group or —CH$_2$— as the X or Y are preferred because the solubility of these polymers in the polymer solution is higher than those having no substituent, so that the affinity for carbon black is further promoted. Examples of these polymers may include those containing 50 mol % or more of

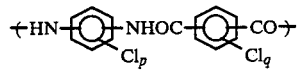

(wherein p + q ≧ 1)

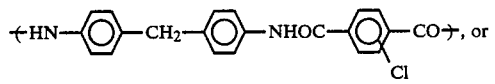

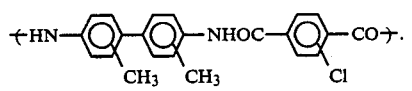

The aromatic polyamides may be obtained by the reaction of an acid chloride with a diamine or by the reaction of an isocyanate with a carboxylic acid. As to the combination of an acid chloride and a diamine, examples of the acid chloride may include terephthaloyl chloride and isophthaloyl chloride, as well as derivatives thereof having halogen, nitro group, alkyl group or alkoxyl group on the benzene ring such as 2-chloroterephthaloyl chloride, 2-chloroisophthaloyl chloride, 2,5-dichloroterephthaloyl chloride, 2-nitroterephthaloyl chloride and 2-methylisophthaloyl chloride. Examples of the diamine may include p-phenylenediamine, m-phenylenediamine, 4,4'-diaminodiphenyl ketone, 3,3'-diaminodiphenyl ketone, 4,4'-diaminodiphenylmethane, 3,4'-diaminodiphenylmethane, 3,3'-diaminodiphenylmethane, 4,4'-diaminodiphenyl ether, 3,3'-diaminodiphenyl ether and benzidine, as well as the derivatives thereof having the above-mentioned substituents on the benzene ring such as 2-chloro-p-phenylenediamine, 2-chloro-m-phenylenediamine, 2-methyl-m-phenylenediamine and 3,3'-dimethylbenzidine.

As to the combination of an isocyanate and a carboxylic acid, examples of the isocyanate may include phenylene-1,4-diisocyanate, phenylene-1,3-diisocyanate, diphenylketone-4,4'-diisocyanate, diphenylmethane-4,4'-diisocyanate, diphenylether-4,4'-diisocyanate and diphenylsulfon-4,4'-diisocyanate, as well as the derivatives thereof having the above-mentioned substituents, such as toluylene-2,6-diisocyanate and toluylene-2,4-diisocyanate. Examples of the carboxylic acid may include terephthalic acid and isophthalic acid, as well as the derivatives thereof which have a substituent on the benzene ring.

It is required that the aromatic polyamide used in the present invention contain the basic recurring unit represented by the above formulae in the amount of not less than 50 mol %, preferably not less than 70 mol %. If the content of the unit is less than the lower limit of the above-mentioned range, the affinity with carbon black is degraded, so that it is impossible to form a film with sufficient mechanical characteristics. In addition, heat resistance is degraded, so that the objects of the present invention cannot be attained. The copolymerized component of the aromatic polyamide which may be contained in the film in the amount of less than 50 mol % is not restricted and may contain an ester bond, urethane bond, imide bond, heterocyclic bond and the like. In order to obtain a film with excellent mechanical characteristics and heat resistance, it is preferred that the polymer have an intrinsic viscosity (the value of a solution containing 0.5 g of the polymer in 100 ml of N-methylpyrrolidone containing 2.5% by weight of lithium bromide, which is measured at 30° C.) of 0.5–6.0.

The aromatic polyamide used in the present invention may contain lubricants, slip agents, antioxidants and/or other additives, as well as other polymers, in an amount not adversely affecting the properties of the film.

Although the carbon black used in the present invention may be any carbon black which is electrically conductive, furnace black and acetylene black are preferred. Further, those carbon blacks which were subjected to a surface treatment for improving electric conductivity may also be used. The carbon black may preferably have a specific surface area of 5–1,000 $m^2/g$, more preferably 10–950 $m^2/g$, an average particle diameter of primary particles of 5–500 nm, more preferably 10–100 nm, and a carbon purity of not less than 90%, more preferably not less than 97%.

The content of the carbon black is 10–40% by weight, more preferably 15–35% by weight. If the content is less than 10% by weight, the electric conductivity is too small to generate heat. On the other hand, if the content is more than 40% by weight, the film is too conductive to sufficiently convert the electric current to Joule's heat, so that the temperature of the film may not be raised satisfactorily. Further, the mechanical characteristics of the film are degraded and so film breakage and wrinkles are brought about frequently, so that it cannot be used in practice.

The film used in the present invention must have a thickness of 1–10 μm, preferably 2–8 μm. If the thickness is less than 1 μm, the strength of the film is so small that the film cannot be used in practice. On the other hand, if the thickness is more than 10 μm, the diffusion of the heat is so great that the topical heating of the film cannot be conducted and the clear printing cannot be obtained. Further, the energy required for the printing is increased, so that it is unsuitable for high speed printing.

It is required that the surface resistivity Rs (KΩ/□) suffice the relationship expressed by $2 \leqq Rs \times t \leqq 100$, more preferably $3 \leqq Rs \times t \leqq 70$, wherein the "t" represents the thickness of the film. If the Rs x t is smaller than the lower limit of the above range, the electric conductivity is so great that the heat to be generated is insufficient. On the other hand, if the Rs x t is greater than the upper limit of the range, the conductivity of the film is too small to generate sufficient heat. It should be noted that although the surface resistivity as defined above may be attained if the amount of the carbon black is in the range of the present invention, in cases where the surface resistivity fluctuates because of the dispersion state of the carbon black, metal powder may be added in the amount not adversely affecting the physical properties of the film in order to stabilize the surface resistivity.

The film used in the present invention has a tensile strength in at least one direction of not less than 8 $kg/mm^2$, more preferably not less than 10 $kg/mm^2$. Although the strength has no upper limit, it may be about 80 $kg/mm^2$. If the strength is not less than 8 $kg/mm^2$, the processability of the image transfer material may be promoted and the film breakage and wrinkles are hardly brought about when the image transfer material is in use.

The dimensional change of the film at 200° C. under a load of 1 $kg/mm^2$ in at least one of the longitudinal and transverse directions is not more than 5%, more preferably not more than 2%. If the dimensional change (shrinkage or elongation) is not more than 5%, wrinkles are hardly formed at the lower portion of the head and clear printing may easily be attained. Further, pinholes are scarcely formed in printing, so that the printing quality is not degraded and the head is not damaged, thus it is suitable for high speed printing.

The film used in the present invention may preferably have a tensile elongation of at least in one of the longitudinal and transverse directions of not less than 10%, more preferably 15%–100%. It is also preferred that the dimensional change of the film at 250° C. under a load of 1 kg/mm$^2$ be not more than 5%.

The film used in the present invention may preferably have a moisture absorption of not more than 4%. If the moisture absorption of hygroscopicity of the film containing the carbon black is in this range, the fluctuation in the resistance of the film caused by the fluctuation in humidity is small, so that stable printing may be attained.

The thermal image transfer ink layer employed in the present invention is not restricted and examples of the ink include fusible ink and sublimatable ink. The ink contains a coloring component and a binder component as the major components and may further contain, if necessary, additives such as a softening agent, plasticizer, smoothing agent, dispersant, surface-forming agent (such as lubricants, slip agents) and the like. The thickness of the ink layer may be 1–20 μm, preferably 2–10 μm.

Although not limited, as the binder component, well-known waxes such as carnauba wax, paraffin wax and ester wax, as well as various low melting macromolecules may be useful, and as the coloring component, carbon black as well as various organic and inorganic pigments and dyes may be useful.

The process of producing the film will now be described. The polymer may be prepared by adding monomers of an acid chloride and a diamine in an organic solvent such as N-methylpyrrolidone (NMP), dimethylacetamide (DMAc), hexamethylphosphoramide (HMPA), dimethylformamide (DMF), tetramethyl urea and γ-butyrolactone to conduct low temperature solution polymerization, or by interfacial polymerization employing an aqueous medium. The polymer may also be produced by adding a catalyst to an iscyanate and a carboxylic acid in an organic solvent such as above-mentioned. In cases where the polymer solution obtained by reacting the acid chloride with the diamine is used as the film-forming solution, hydrogen halide is generated, and it must be neutralized with an inorganic base such as calcium hydroxide, lithium carbonate and calcium carbonate, as well as a hydrate thereof, or with ammonia or an organic base such as triethylamine, diethanolamine, ethylene oxide and propylene oxide so as to ensure that the hydrogen halide does not adversely affect the processing in the later film-forming steps. The neutralization salt generated by the neutralization acts as a solubilizer to promote the solubility of the polymer. An alkaline metal halide or an alkaline earth metal halide such as lithium chloride, lithium bromide and calcium chloride may be added separately. The preferred amount thereof is 50 mol % or less of amide group, i.e., 150 mol % or less in terms of total amount with the neutralization salt. In some cases, depending on the kind of the basic recurring unit and/or the copolymer unit, a stable solution may be obtained without the solubilizer or even if the amount of the solubilizer is less than the amount of the neutralization salt, and the film-formation may be better accomplished. In these cases, it is possible to control the amount of the polymer and the solubilizer by, for example, adding isolated polymer to the solvent.

The polymer may be isolated by casting the polymer solution into water, which solution contains the polymer polymerized in an organic solvent to precipitate the polymer or by washing and drying the polymer generated by interfacial polymerization.

The carbon black may be well dispersed in an organic solvent or in a small amount of the polymer solution and may then be added to the film-forming solution. Alternatively, the carbon black may be directly added to the film-forming solution.

The concentration of the polymer in the thus prepared film-forming solution may preferably be 2–40% by weight. In cases where the salt generated by the neutralization and/or the inorganic salt as the solubilizer are contained, the film may preferably be formed by a wet process or dry-wet process. In the wet process, the film-forming solution is directly extruded through a die into a film-forming bath or is once casted on a support such as a drum and then is put in a bath together with the support. The bath contains an aqueous medium which may contain an organic solvent and an inorganic salt, in addition to water, although the water content is generally 30% by weight or more. The bath temperature is usually 0°–100° C. and the extraction of the salts and organic solvents contained in the film is conducted in the bath. Then the film is stretched in the longitudinal direction. The film from the bath is then dried, stretched and heat-treated, which are usually conducted at a temperature of 100°–500° C.

In the dry-wet process, the film-forming solution is extruded from a die onto a support such as a drum and an endless belt to form a thin film, and the thus formed thin film is dried to remove the solvent until the thin film can sustain its form by itself. The drying is usually conducted at a temperature of from room temperature to 300° C. for upto 60 minutes. The film which finishes the above-mentioned dry process is then peeled off from the support and is introduced in the wet process in which elimination of the salt and the solvent is conducted as in the above-described wet process. The film is then stretched, dried and heat-treated to form a finished film.

In some cases, depending on the amount of the basic recurring unit and on the distribution of the copolymer unit, the polymer may be dissolved in an organic solvent without an inorganic salt. In such a case, the film may be formed by a dry process. Needless to say, the film may also be formed by the above-mentioned wet process or dry-wet process.

In the dry process, the film dried on a support such as a drum and an endless belt until it can sustain its form by itself is peeled off from the support and the film is then stretched in the longitudinal direction. The film is then dried until the amount of the remaining voratiles decreases to 3% or less and then the film is stretched and heat-treated. These treatments are usually conducted at a temperature of from 150°–500° C.

In the steps of forming the film as mentioned above, the film is stretched and heat-treated so as to acquire the mechanical characteristics, thermal characteristics and electric characteristics defined by the present invention. More particularly, in view of promoting the electric conductivity and maintaining the mechanical characteristics and thermal characteristics, the heat-treatment may preferably be conducted at 250°–350° C. for 0.1 second to 1 minute and the stretching may preferably be conducted at a stretching ratio in terms of area stretching ratio of 0.9–3.0. (Area stretching ratio is defined as the value obtained by dividing the area after stretching by the area before stretching. The area stretching ratio of 1 or less means relaxation.) If the area stretching ratio is more than 3.0, although the mechanical properties are promoted, the electric conductivity is severely degraded and the heat resistance is also degraded, so that it is not preferred for the purpose of the present invention.

Then the ink layer is formed on the thus prepared base film. Before forming the ink layer, the film may be subjected to a pretreatment such as corona treatment and glow discharge. The ink as mentioned above may be used and the ink may be applied on a surface of the film by hot-melt technique or by a well-known application method employing a gravure roll coater, reverse roll coater or slit die.

Although the basic structure of the image transfer material for thermal recording of the present invention consists of the above-mentioned base film and the ink layer, for the purpose of further promoting the printing properties, an electric conductive layer made of, for example, Al, Au, Ag, Ni, Cr, Co, Zn, Sn, Mo or W, or an alloy, oxide or nitride thereof, which layer has a thickness of 20–500 nm, preferably 40–300 nm may be provided between the film and the ink layer (in this case the conductive layer is called as intermediate layer) or on the surface of the image transfer material which contacts the recording head. Forming the electric conductive layer as the intermediate layer is very effective for topically increasing the electric current density of the electric current from the recording head. On the other hand, if the electric conductive layer is provided on the side of the image transfer material which contacts the recording head, the contact electric resistance is decreased, so that the recording energy is effectively used, thus it is also preferred. Further, in the present invention, as an intermediate layer, a layer other than the electric conductive layer such as peeling layer, lubricating layer and heat resistant layer may be formed with or without the electric conductive layer.

The methods of measuring the physical properties of the film used in the present invention will now be described.

(1) Surface Resistivity Rs

A circular main electrode with a diameter of 16 mm and an annular opposite electrode with an inner diameter of 30 mm and an outer diameter of 34 mm were concentrically placed on a surface of the film under a load of 1 kg. Electric current was conducted between the electrodes and the electric resistance was read. The surface resistivity Rs was calculated by the following equation:

$$Rs=(P/g)\times R$$

wherein

Rs: surface resistivity (kΩ/□)

P: effective length of circle circumference of the electrode (7.23 cm)

g: distance between the electrodes (0.7 cm)

R: actually measured resistance (kΩ).

(2) Tensile Strength and Tensile Elongation

The film was set in a Tensilon type tensile tester such that the testing width was 10 mm and the testing length was 50 mm. The film was then stretched at a rate of 300 mm/min, and the tensile strength and the tensile elongation at break were measured at 25° C., 55% RH.

(3) Dimensional Change

The film was cut into a size of 10 mm width×200 mm length and was heated in an oven with a temperature of 200° C. for 5 minutes under a load of 1 kg/mm$^2$. The film sample was taken out of the oven and was allowed to cool to ambient temperature. The dimensional change (DC) was calculated by the following equation:

$$DC\,(\%) = \frac{LAH - LBH}{LBH} \times 100$$

(wherein LAH means the length after heating and LBH means length before heating)

The invention will now be described by way of examples. The present invention is not restricted to these examples.

EXAMPLE 1

To a 300 liter stirrer with a jacket, 120 kg of distilled NMP and 100 moles (10.82 kg) of m-phenylenediamine were fed and dissolved. The solution was cooled to 10° C. and 100 moles (20.30 kg) of isophthaloyl chloride was added and the mixture was stirred for 2 hours. The calculated amount of calcium hydroxide equivalent to the generated hydrogen chloride was added and the mixture was stirred for another 5 hours to complete the neutralization. The viscosity of the solution was 5,000 poises (30° C.), and the intrinsic viscosity was 1.27.

Fifty kilograms of the solution was taken and 3.70 kg of carbon black was added thereto. The mixture was well stirred to obtain a uniform solution.

The solution was uniformly casted on a metal drum at 30° C. and was dried at 120° C. for 10 minutes. The casted film was peeled off from the drum and was continuously stretched in the machine direction to 1.1 times the original length while being immersed in water bath for 30 minutes. The film was then introduced into a tenter and was stretched in the transverse direcion to 1.1 times the original length at 300° C. to obtain a uniform film with a thickness of 6 μm which had a balanced physical properties in the machine and the transverse directions. The dwelling time in the tenter was 20 seconds. As shown in Table 1, this film was excellent in both mechanical characteristics and thermal characteristics.

On the thus formed film, an ink layer with the following composition was applied to a thickness of 4 μm by the hot-melt coating method using a heat roll to obtain an image transfer ribbon.

Carnauba Wax: 35 parts
Ester Wax: 33 parts
Carbon Black: 17 parts
Polytetrahydrofuran: 12 parts
Silicone Oil: 3 parts Using the ribbon, printing was conducted on a normal paper with an applied electric current of 20 mA and a pulse width of 1 msec. employing an electrode head with the recording styli density of 10 styli/mm and a constant power supply. As a result, very clear characters were printed. Further, troubles such as formation of wrinkles, breakage of the ribbon and formation of pinholes were not caused.

EXAMPLE 2

To 50 kg of the polymer solution obtained in Example 1, 2.51 kg of carbon black was added and a film with a thickness of 6 μm was obtained by the same manner as in Example 1. As shown in Table 1, the film was excellent in both mechanical characteristics and thermal characteristics. On the film, an ink layer was coated to a thickness of 4 μm as in Example 1, and printing was conducted with a pulse width of 0.6 msec. As a result, clear characters as in Example 1 were printed. Further, troubles such as formation of wrinkles, breakage of the ribbon and formation of pinholes were not caused.

EXAMPLES 3–5

Diamine components of 75 mol % of 2-chloro-p-phenylenediamine and 25 mol % of 4,4'-diaminodiphenylether and 100 mol % of 2-chloro-terephthaloyl chloride were polymerized and neutralized in NMP to obtain a polymer solution with a polymer concentration of 10% by weight, solution viscosity of 6,000 poises (30° C.) and an intrinsic viscosity of 2.8.

The same procedure as in Example 1 was followed except that the carbon black was added to a final concentration shown in Table 1 and the stretching ratios in both the machine and the transverse directions were 1.0 times the original length, to obtain films with a thickness of 4 μm, which had balanced physical properties in both the machine and the transverse directions. The obtained films were excellent in both mechanical characteristics and thermal characteristics. In Examples 3 and 4, the ink layer as in Example 1 was coated on the films and printings were conducted with an electric current of 20 mA and a pulse width of 0.7 msec. As a result, although the color is deeper when the amount of carbon black is smaller, clear printed characters were obtained in either cases. Further, troubles such as formation of wrinkles, breakage of the ribbon and formation of pinholes were not caused.

In Example 5, on the same film as in Example 3, aluminum was vapor-deposited to a thickness of 100 nm and the same ink layer as in Example 3 was coated thereon to form an image transfer ribbon. Using this ribbon, printing was conducted on bond paper with an electric current of 15 mA and a pulse width of 1 msec. As a result, very clear characters were printed. Further, the running of the ribbon was not hindered at all and piholes were not formed.

EXAPLES 6 and 7

One hundred mol % of 4,4'-diaminodiphenylmethane and 100 mol % of terephthaloyl chloride were polymerized and neutralized in NMP to obtain a polymer solution with a polymer concentration of 13% by weight, a solution viscosity of 5,000 poises and an intrinsic viscosity of 1.50. Carbon black was added thereto and films with a thickness of 6 μm was obtained as in Example 1. In Example 7, Ni fine powder with a particle size of 50 nm was added in the amount of 20% by weight with respect to the carbon black. As shown in Table 1, these films were excellent in both mechanical characteristics and thermal characteristics. On these films, aluminum was vapor-deposited to a thickness of 100 nm and the same ink layer as mentioned above was coated to a thickness of 4 μm. Using the thus formed ribbons, printings were conducted with an electric current of 10 mA or 20 mA and a pulse width of 1 msec. As a result, clear characters were printed in each printing. Further, breakage of the ribbon did not happen and pinholes were not formed, so that it was confirmed that the ribbons were excellent.

EXAMPLES 8 and 9

One hundred mol % of 4,4'-diaminodiphenylmethane and 100 mol % of 2-chloro-terephthaloyl chloride were polymerized and neutralized in NMP to obtain a polymer solution with a polymer concentration of 15% by weight, a solution viscosity of 4,000 poises and an intrinsic viscosity of 1.45. Carbon black was added thereto and films with a thickness of 6 μm were obtained as in Example 1. The carbon black content, mechanical characteristics and thermal characteristics of these films are shown in Table 1.

On the films, aluminum was vapor-deposited to a thickness of 100 nm and the same ink layer as mentioned above was coated to a thickness of 4 μm. Using the thus formed ribbons, printings were conducted with an electric current of 10 mA or 20 mA and a pulse width of 0.7 msec. As a result, clear characters were printed in each printing. Further, breakage of the ribbon did not happen nnd pinholes were not formed, so that it was confirmed that the ribbons were excellent.

COMPARATIVE EXAMPLES 1–3

To the same polymer as in Example 1, carbon black was added in the amount which is outside of the range defined in the present invention and films with a thickness of 6 μm were obtained as in Example 1 (Comparative Examples 1 and 2).

In comparative Example 1, the film coated with the ink layer was subjected to printing, but the transfer of the ink did not occur.

In Comparative Example 2, since the amount of the carbon black was large, breakage of the film occurred many times in coating the ink and in printing. Further, although printing was tried under the same conditions as in Example 1, the transfer of the ink did not occur. Although printing was tried again applying increased electric current, only faint characters were printed. It is assumed that this is because that the applied electric power was scarecely converted to Joule's heat due to the too high electric conductivity.

In Comparative Example 3, the film made from the polymer solution containing the same polymer and the same amount of carbon black as in Example 1 was stretched in the machine direction to 1.5 times the original length and in the transverse direction to 1.6 times the original length at 270° C. to obtain a film with a thickness of 6 μm. The characteristics of the film are shown in Table 1. The ink layer used in Example 1 was coated on the film and printing was conducted as in Example 1. As a result, running of the ink was observed. Further, the non-printing portion of the ribbon was slackened. It is considered that running of the ink was caused because the position of the image transfer was shifted in printing due to the shrinkage of the film. Pinholes were not formed in the film.

COMPARATIVE EXAMPLE 4

Diamine components of 30 mol % of m-phenylenediamine and 70 mol % of 1,4-bis(4-aminophenoxy)benzene, and 100 mol % of isophthaloyl chloride were polymerized and neutralized in NMP to obtain a polymer solution with a polymer concentration of 20% by weight, a solution viscosity of 2,000 poises and an intrinsic viscosity of 1.20. The polymer contains the basic recurring unit defined in the present invention in the amount of 30 mol %. Carbon black was added thereto and the solution was casted on a metal drum, dried and stretched in water bath at a stretching ratio in the machine direction of 1.2 times the original length. The film was then stretched to 1.2 times the original length in the transverse direction at 270° C. to obtain a film with a thickness of 6 μm. The characteristics of the thus obtained film are shown in Table 1.

The ink layer was coated on the film as in Example 1 and printing test was conducted as in Example 1. Since the film had bad mechanical characteristics, breakage of the film occurred many times in printing, and running of the ink was observed in the printed characters. Further, the ribbon was slackened and pinholes were formed in the ribbon.

COMPARATIVE EXAMPLE 5

Fifty grams of polycarbonate resin was dissolved in 700 g of dichloromethane and 25 g of carbon black was added to the solution to obtain a uniform solution. The resulting solution was casted on a glass plate and was dried at 80° C. for 15 minutes to obtain a film with a thickness of 10 μm. The characteristics of the film are shown in Table 1. On this film, aluminum was vapor-deposited to a thickness of 100 nm and the ink layer used in Example 1 was coated to a thickness of 4 μm. The printing test was conducted for the thus obtained ribbon as in Example 5. As a result, breakage of the ribbon occurred many times since the ribbon was weak. Although printing could manage to conduct, staining is severe and the printing quality was considerably lower than that obtained in Example 5. Further, pinholes were observed in the ribbon, and the slack was large, so that the winding of the ribbon could not be conducted smoothly.

COMPARATIVE EXAMPLE 6

Carbon black was added to the polymer used in Comparative Example 4 and the procedure in Comparative Example 4 was repeated, except that the stretching ratio in the machine direction was 1.0 times the original length and the stretching in the transverse direction was conducted at 330° C. at a stretching ratio of 1.0 times the original length, to obtain a film with a thickness of 6 μm. The characteristics of the film are shown in Table 1. Although the heat resistance was good, the mechanical characteristics were bad. The ink layer was formed on the film and the printing test was conducted as in Comparative Example 4. As a result, breakage of the film occurred many times and running of the ink was observed in the printed characters. Further, many pinholes were formed in the film.

TABLE 1-1

| | Thickness (μm) | Content of Carbon Black (wt %) | Surface Resistivity (KΩ/□) | Tensile Strength (kg/mm²) | Tensile Elongation (%) | Young's Modulus (kg/mm²) | Dimensional Change (%) |
|---|---|---|---|---|---|---|---|
| Example 1 | 6 | 33 | 1.6 | 12.0 | 12.3 | 380 | +0.8 |
| Example 2 | 6 | 25 | 5.8 | 21.0 | 30.3 | 480 | +1.5 |
| Example 3,5 | 4 | 35 | 7.2 | 18.0 | 14.2 | 570 | +0.2 |
| Example 4 | 4 | 22 | 16.3 | 32.3 | 26.6 | 650 | +0.3 |
| Example 6 | 6 | 20 | 11.0 | 18.5 | 25.0 | 350 | +1.1 |
| Example 7 | 6 | 19 (Ni 3.8 wt %) | 1.0 | 11.5 | 18.2 | 300 | +0.7 |
| Example 8 | 6 | 25 | 8.3 | 18.7 | 24.3 | 360 | +0.8 |
| Example 9 | 6 | 33 | 2.0 | 16.5 | 18.1 | 350 | +0.7 |

TABLE 1-2

| | Thickness (μm) | Content of Carbon Black (wt %) | Surface Resistivity (KΩ/□) | Tensile Strength (kg/mm²) | Tensile Elongation (%) | Young's Modulus (kg/mm²) | Dimensional Change (%) |
|---|---|---|---|---|---|---|---|
| Comparative Example 1 | 6 | 8 | 1000 or more | 24.1 | 52.5 | 490 | +1.4 |
| Comparative Example 2 | 6 | 45 | 0.3 | 4.3 | 5.5 | 280 | +0.6 |
| Comparative Example 3 | 6 | 33 | 15.3 | 15.0 | 10.8 | 420 | −8.2 |
| Comparative Example 4 | 6 | 33 | 1.1 | 5.1 | 6.1 | 180 | +7.3 |
| Comparative Example 5 | 10 | 33 | 0.7 | 4.8 | 7.2 | 230 | +210 |
| Comparative Example 6 | 6 | 33 | 1.0 | 4.8 | 6.5 | 170 | +1.9 |

INDUSTRIAL APPLICABILITY

As described above, since the image transfer material for thermal recording of the present invention employs as the polymer of the base film aromatic polyamide having a good affinity for carbon black, is excellent in mechanical characteristics and thermal characteristics. Thus, it is excellent as a thin image transfer material for thermal recording of the electric current-conducting type.

The image transfer material may be used in the form of ribbon and sheet. As the ink layer, fusible ink and sublimatable ink may be used.

We claim:

1. An image transfer material for thermal recording comprising an aromatic polyamide film with a thickness t of 1–10 μm, said film comprising a polymer containing not less than 50 mol % of a basic recurring unit represented by the formula:

$$—HN\text{-}Ar_1\text{-}NHOC\text{-}Ar_2\text{-}CO—$$

wherein $Ar_1$ and $Ar_2$ represent the following structures (1) and (2), respectively:

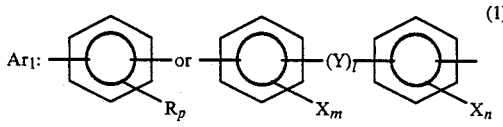

(1)

wherein R and X represent halogen, nitro group, $C_1$–$C_3$ alkyl group or $C_1$–$C_3$ alkoxy group; Y represents $$-\underset{\underset{O}{\|}}{C}-,$$

$-CH_2-$, $-O-$, or $-SO_2-$; p, m and n represent 0–3, and l represents 0 or 1.

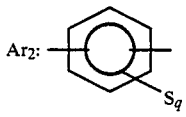

(2)

wherein S represents halogen, nitro group, $C_1$–$C_3$ alkyl group or $C_1$–$C_3$ alkoxy group; and a represents 0–4;

which film contains 10–40% by weight of carbon black and has a moisture absorption of not more than 4% and a tensile strength in at least one direction of not less than 8 kg/mm$^2$, the surface resistivity Rs (KΩ/□) of the film satisfying the relationship of $2 \leqq Rs \times t \leqq 100$, the dimensional change of the film in at least one direction at 200° C. under the load of 1 kg/mm$^2$ being not more than 5%; and an ink layer formed on the film.

2. The image transfer material for thermal recording of claim 1, characterized in that the carbon black has a specific surface area of 5 m$^2$/g–1000 m$^2$/g.

3. The image transfer material for thermal recording of claim 1 or 2, characterized in that primary particles of the carbon black have an average diameter of 10–100 nm.

4. The image transfer material for thermal recording of claim 1, characterized in that the aromatic polyamide film has a tensile elongation at break of not less than 10% in at least one direction.

5. The image transfer material for thermal recording of claim 1, characterized in that the aromatic polyamide film has a moisture absorption of not more than 4%.

6. The image transfer material for thermal recording of claim 1, characterized in that the surface resistivity Rs (kΩ/□) satisfies the relationship of $3 \leqq Rs \times t \leqq 70$.

7. The image transfer material for thermal recording of claim 1, wherein the thickness of the film is 2–8 μm.

8. The image transfer material for thermal recording of claim 1, wherein the percentage of said recurring unit in said polymer is at least 70 mol %.

* * * * *

UNITED STATES PATENT AND TRADEMARK OFFICE

CERTIFICATE OF CORRECTION

PATENT NO. : 4,849,287

DATED : July 18, 1989

INVENTOR(S) : Nobuaki Itoh et al

It is certified that error appears in the above-identified patent and that said Letters Patent is hereby corrected as shown below:

Column 12:

Claim 1, line 6, change the formula to the following:

$$--HN\text{-}Ar_1\text{-}NHOC\text{-}Ar_2\text{-}CO--.$$

Signed and Sealed this

Sixteenth Day of January, 1996

*Attest:*

*Attesting Officer*

Bruce Lehman

BRUCE LEHMAN

*Commissioner of Patents and Trademarks*